US005526538A

United States Patent [19]

Rainwater

[11] Patent Number: 5,526,538

[45] Date of Patent: Jun. 18, 1996

[54] WATER CIRCULATION AND HEATING SYSTEM FOR SPAS

[75] Inventor: Jack D. Rainwater, Costa Mesa, Calif.

[73] Assignee: Hurrican Products Incorporated, Anaheim, Calif.

[21] Appl. No.: 435,475

[22] Filed: May 4, 1995

[51] Int. Cl.[6] ..... F04H 4/12

[52] U.S. Cl. ..... 4/541.1; 4/541.3; 4/492; 4/493

[58] Field of Search ..... 4/541.1, 541.2, 4/541.3, 541.4, 541.5, 492, 493; 165/177; 137/341

[56] References Cited

U.S. PATENT DOCUMENTS

| | | | |
|---|---|---|---|
| 3,580,227 | 5/1971 | Koestel | 165/177 |
| 3,837,016 | 9/1974 | Schindler et al. | 4/493 |
| 4,199,675 | 4/1980 | Sharpless | 137/341 |
| 4,330,412 | 5/1982 | Frederick | 4/492 |
| 4,529,033 | 7/1985 | Blum | 4/493 |
| 4,564,962 | 1/1986 | Castleberry et al. | 4/541.4 |
| 4,924,069 | 5/1990 | Giordani | 219/306 |
| 5,226,408 | 7/1993 | Drysdale | 4/541.3 |
| 5,345,996 | 9/1994 | Druien | 4/541.2 |

*Primary Examiner*—Henry J. Recla
*Assistant Examiner*—Charles R. Eloshway
*Attorney, Agent, or Firm*—Koppel & Jacobs

[57] ABSTRACT

A water circulation and heating system for spas which exhibits low power consumption for continuous circulation of the spa water while avoiding air entrapment in the water heating unit comprises a low speed water pump, and a heater that is configured so that water flows through it generally vertically. The low speed pump circulates spa water through the heater at a low flow rate that would cause air entrapment in the heater if it were configured so that water flowed through it horizontally. In a preferred embodiment, a high speed water pump is also provided for operating the spa's high speed jets when the spa is in use. The low and high speed pumps preferably form part of an interconnected water circulation system, so that the water flow rate through the heater is increased when the high speed jet pump is activated.

11 Claims, 4 Drawing Sheets

WATER CIRCULATION AND HEATING SYSTEM FOR SPAS

BACKGROUND OF THE INVENTION

1. Field of the Invention

The present invention relates to spas and hot tubs and, more specifically, to a water circulation and heating system that utilizes a low flow rate water pump.

2. Description of the Related Art

Water circulation and heating systems for spas and hot tubs generally fall into one of two categories: 24-hour dual pump systems and 2-speed single pump systems.

In 2-speed single pump systems, a single two-speed pump is used for water circulation, which includes filtering and heating of the water, and for powering the high speed jets that are typically turned on when the spa is in use. The low speed is used to circulate the water for the purposes of heating and filtration, and the high speed is used to power the high speed jets.

Current two-speed pump systems use a high Wattage motor (typically 598 Watts or higher) which, at its low speed setting, circulates the spa water at a flow rate of approximately 15 gallons per minute (gpm) (57 liters per minute (lpm)). At its high speed, the pump circulates the water at a flow rate of between 60 and 120 gpm (227 and 455 lpm). As the spa water is circulated, it is filtered, chemically treated and heated. The heating is accomplished with a heater, which typically comprises an electrical heating element inside a cylindrical housing. Although some earlier 2-speed pump systems utilized vertically mounted heaters (in which water flows through the housing in a vertical direction), modern systems opt for horizontally mounted heaters, such as the one described in U.S. Pat. No. 4,924,069, entitled "HOT WATER SUPPLY FOR TUBS", issued May 8, 1990 to Attillo G. Giordani. Horizontally mounted heaters are generally preferred in the industry because head loss (pressure loss) problems are encountered when water is forced through a vertically mounted heater, especially at the high water flow rates used in two-speed pump systems.

Another problem with 2-speed pump systems is the pump's high power consumption. Even at its low speed setting, the 2-speed pump's power consumption is high enough to make it impractical to run continuously. As a result, 2-speed systems are configured so that the spa water is circulated intermittently over a 24 hour period (typically only 5 hours over a 24 hour period). The intermittent circulation periods can be initiated by a timer or manually. When the spa water is not being circulated, it can become dirty from lack of filtration and its temperature goes down from lack of heating. Furthermore, 2-speed pumps are relatively noisy, which may make the spa systems that incorporate them unsuitable for certain areas of the home (such as bedrooms).

With 24-hour dual pump systems, two separate pumps are used in two separate circulation systems. A low speed pump is used to circulate the spa water through a low speed circulation system that is used for heating and filtration. A second high speed pump is used to circulate the spa water through high speed jets in a separate high speed circulation system when the spa is in use. The low speed pump consumes less power and produces less noise than the 2-speed pumps described above. As a result, it may be operated continuously so that the water is continuously filtered and heated, and it may be located in noise sensitive areas of the home.

However, the low speed pump circulates the water at a flow rate of 15 gpm (57 lpm) or less, which causes problems with the horizontally mounted heater that is used to heat the water. It is common for some amount of air to make its way into the circulation system. The air eventually propagates to the heater housing, where it becomes trapped because the low speed pump does not generate enough pressure to force the air out of the heater housing. The air lowers the water level in the heater housing, which can expose portions of the heater element. The exposed heater element portions become much hotter than the submersed portions, and this can cause the heater element to overheat and fail. In addition, although the continuous filtering of the spa water at flow rates of less than 15 gpm (57 lpm) is sufficient for keeping the water clean when the spa is not in use, a higher amount of water filtration is desirable when the spa is in use.

SUMMARY OF THE INVENTION

In view of the above problems, the present invention provides a water circulation and heating system for spas which exhibits low enough power consumption to allow for continuous circulation of the spa water, while avoiding the air entrapment problems exhibited by prior systems.

This is accomplished by providing a low speed water pump, and a heater that is configured so that water flows through it generally vertically. The low speed pump circulates spa water through the heater at a low flow rate that would cause air entrapment in the heater if it were configured so that water flowed through it horizontally.

In a preferred embodiment, a high speed water pump is also provided for operating the spa's high speed jets when the spa is in use. The low and high speed pumps preferably form part of an interconnected water circulation system, so that the water flow rate through the heater and filter is increased when the high speed jet pump is activated, thereby increasing the amount of water filtration when it is most needed (i.e., when the spa is in use).

These and other features and advantages of the invention will be apparent to those skilled in the art from the following detailed description of preferred embodiments, taken together with the accompanying drawings, in which:

Figure 2:
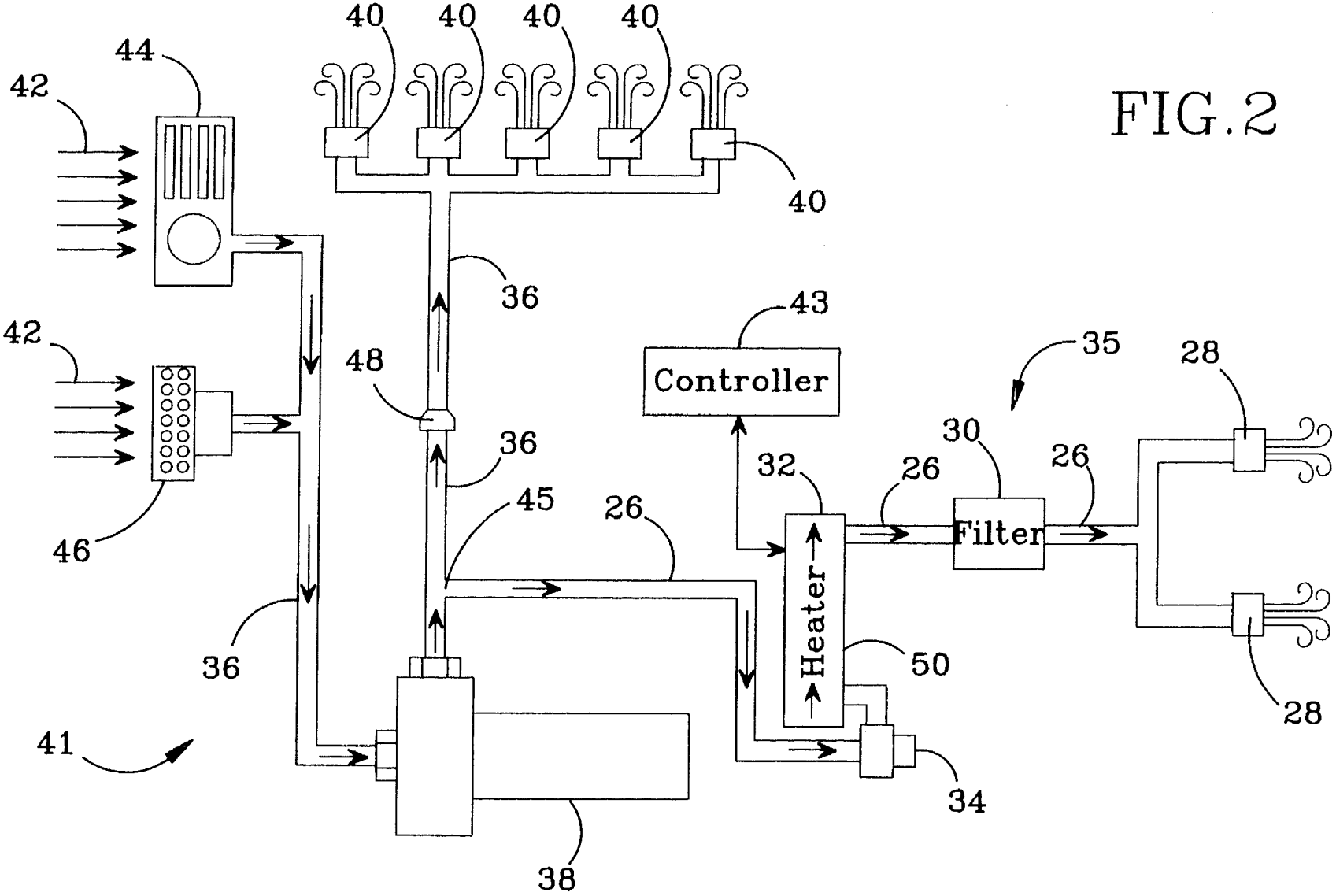
FIG. 2 is a schematic diagram of a preferred spa circulation and heating system built in accordance with the present invention.
Figure 4:
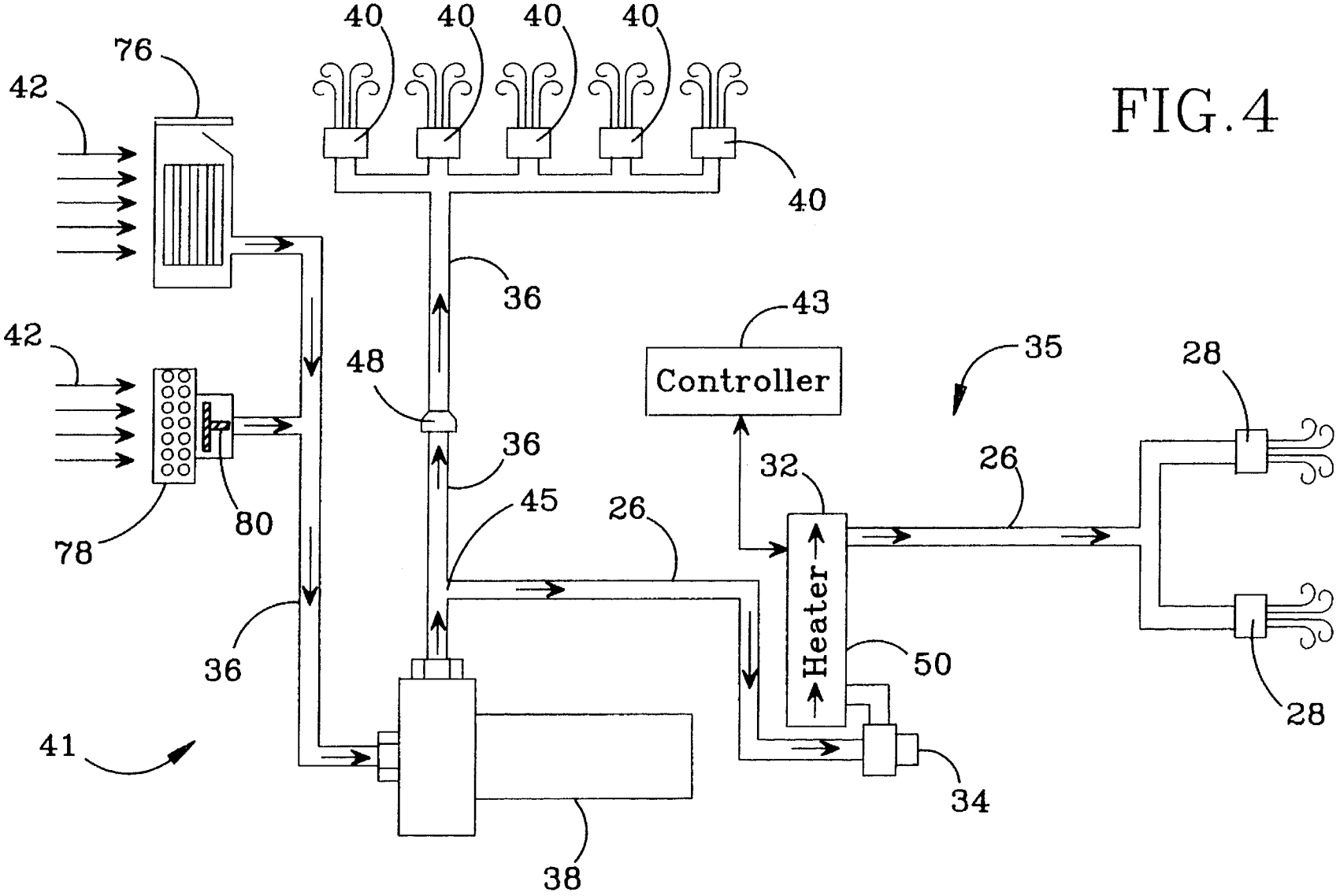

FIGS. *3a–3c* are respectively front elevation, side elevation and plan views of a preferred water heater for use in the embodiments of FIGS. 2 and 4.

FIG. 4 is a schematic diagram of the spa circulation and heating system of FIG. 2, modified so that water filtration is performed at an input side of a high speed pump.

DETAILED DESCRIPTION OF THE INVENTION

Figure 1:
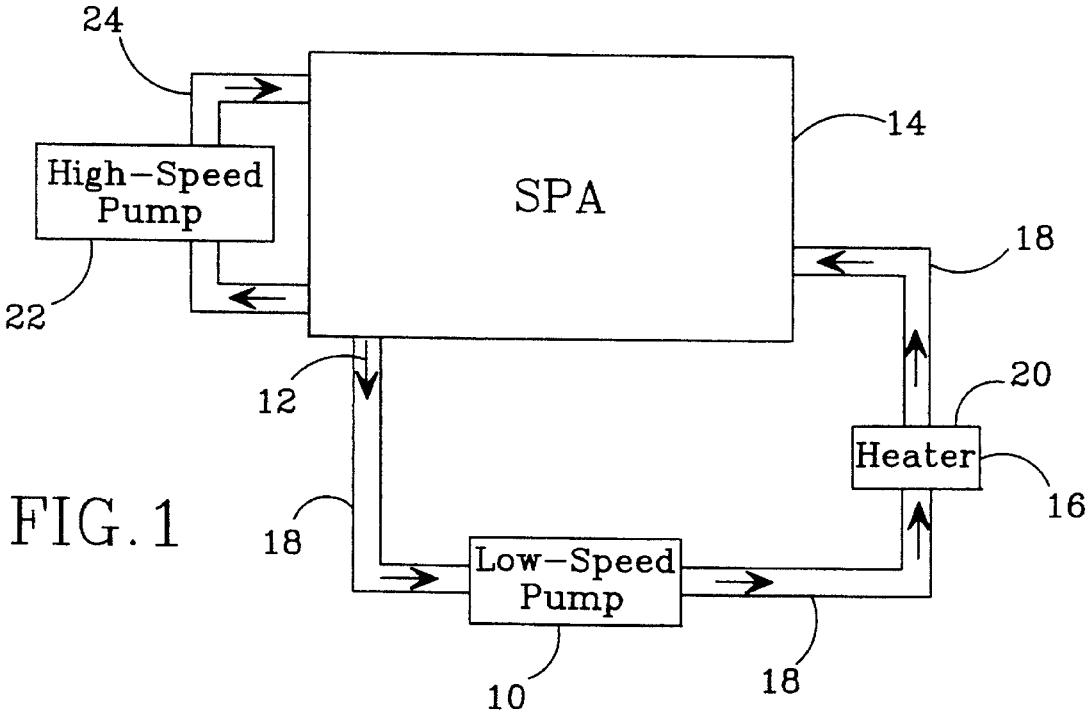
FIG. 1 is block diagram illustrating the basic principles of the invention.

FIG. 1 illustrates the basic principles of the invention. A low speed water pump 10 circulates water 12 from a spa 14 through a heater 16 that is configured so that water flows through it generally vertically.

The low speed pump 10 circulates the spa water 12 through the heater 16 via piping 18 at a low flow rate that would cause air entrapment in the heater 16 if it were configured so that water flowed through horizontally. In the present invention, any air that finds its way to the heater 16 will rise to its top side 20 and escape through the piping 18. By substantially eliminating air entrapment in the heater, the low speed pump 10 can be small enough (i.e., a low power consumption motor) to be operated continuously. A separate high speed pump 22 is used to power the spa's high speed jets (not shown) via piping 24 when the spa is in use.

FIG. 2 illustrates a preferred embodiment of the invention. Piping 26, low speed jets 28, filter 30, heater 32 and low speed pump 34 form a low speed water circulation system 35. Piping 36, high speed pump 38 and high speed jets 40 form a high speed water circulation system 41. As illustrated in FIG. 2, the two systems are preferably interconnected at a point 45. A spa controller 43 controls the operation of the pumps and heater.

When the low speed pump 34 is operating and the high speed pump 38 is idle, spa water 42 is drawn in through skimmer 44 and suction fitting 46. The water flows through the idle high speed pump 38, the low speed pump 34, heater 32, water filter 30 and finally flows back into the spa (not shown) through low speed jets 28. A one-way swing check valve 48 keeps water from being drawn in through the high speed jets 40.

The heater, described in more detail below, is preferably comprised of an electrical helical heating coil (not shown) in a cylindrical heater housing 50 and is mounted so that the housing's longitudinal axis is generally vertical. The controller monitors the temperature of the water flowing through the heater housing 50 and regulates the current applied to the heater coil. The low speed pump 34 is preferably a low power pump, suitably a Grundfos™ 67 Watt circulating pump, that can be run continuously and that circulates the water at a flow rate preferably between 5 and 6 gpm (19 and 23 lpm). At these low flow rates, minimal head loss occurs at the vertical mounted heater 32.

When the spa is in use, the user may activate the high speed jets 40 by activating the high speed pump 38, which is preferably a 1–4 horsepower (0.75–3.0 Kilowatt) water pump that circulates the water through the high speed circulation system 41 at a flow rate greater than 15 gpm (57 lpm). Suitable pumps are commercially available from Waterway Plastics (Models SP1.0–SP4.0). When the high speed pump 40 is activated, water is drawn in through the skimmer 44 and suction fitting 46 at a higher flow rate. The high speed water exits the high speed pump 38, flows through the one-way valve 48 and flows back into the spa through high speed jets 40. A portion of the high speed water flows into the low speed circulation system 35 via piping 26. This increases the water flow rate through the low speed system 35, which increases the amount of water filtration when the spa is in use.

In the preferred embodiment, the high speed pump circulates the water at a flow rate of 80 gpm (303 lpm) through the high speed circulation system 41. The low and high speed circulation systems 35 and 41 are preferably connected so that the water flow rate in the low speed system 35 doubles to approximately 10–12 gpm (38–46 lpm) when the high speed pump 38 is activated. This doubles the amount of water filtration when the spa is in use, while still maintaining a sufficiently low flow rate through the vertically mounted heater 32 to avoid excessive head loss.

Figure 3A:
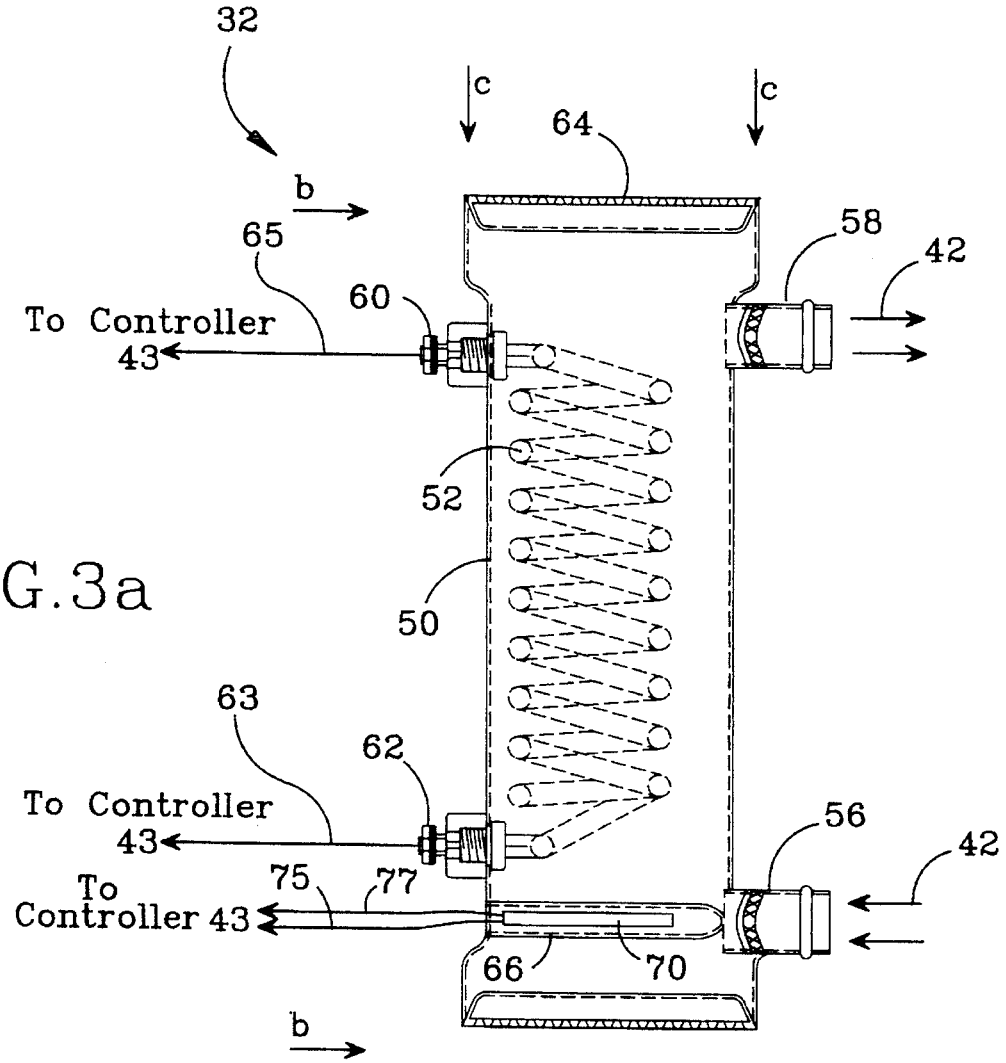
Figure 3B:
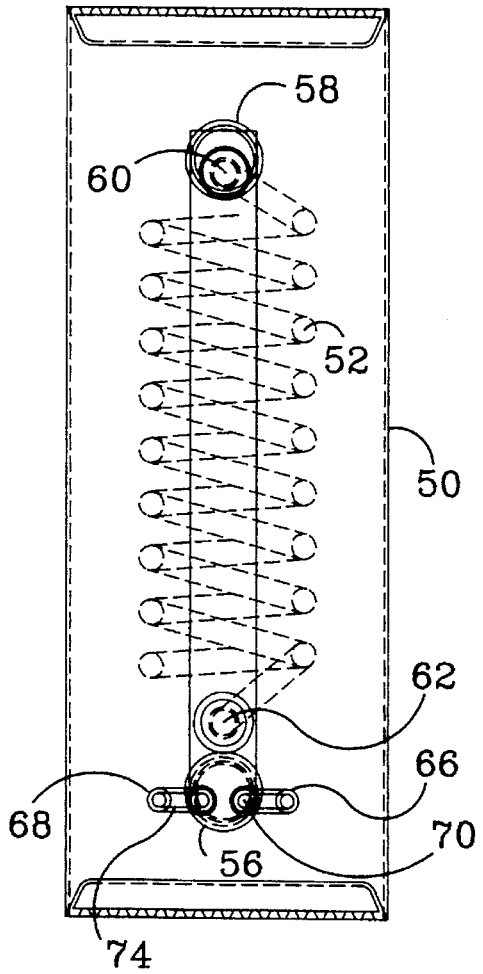
Figure 3C:
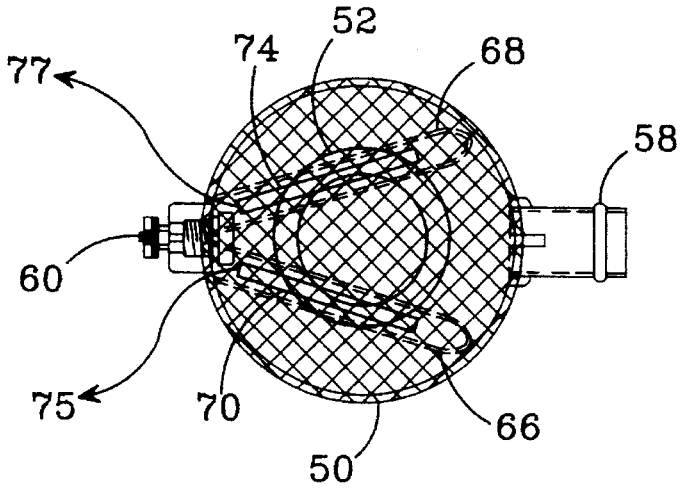

A preferred heater 32 incorporates a design that is generally used in the art, and is illustrated in FIGS. 3*a*–3*c*. It comprises an electrical helical heating coil, shown as dotted outline 52, inside a cylindrical heater housing 50. The heater housing 50 is preferably made of stainless steel. In operation, the spa water 42 enters through input port 56, flows through the heater housing 50 and exits through output port 58. The spa controller (43 in FIG. 2) applies a current to coil 52 through terminals 60 and 62 and signal lines 63 and 65, which causes the coil 52 to heat up. As the water 42 flows through the housing 50 it is heated by the coil 52.

The heater coil 52 preferably has a Watt density rating of less than 100 Watts per square inch so that the spa water 42 does not boil as it flows through the heater housing 50. Boiling could result in the formation of calcium deposits on the heater coil 52, which would reduce its efficiency and life. As explained above, if air enters the housing 50 it rises to the top end 64 of the housing and exits through port 58, which keeps the water level in the housing 50 from falling to a point at which the coil 52 is exposed. It is preferable to mount the heater 32 so that its longitudinal axis is as close to vertical as possible. However, the heater may be tilted somewhat off vertical, as long as enough air can escape through port 58 to keep the coil 52 from being exposed. The applicants expect that tilts as large as 20 degrees can be tolerated, and the term "generally vertical" is intended to include all angles within this range.

The housing 50 preferably contains two temperature sensor wells 66 and 68 for accommodating temperature sensors 70 and 74, which are suitably glass-filled bulb capillary sensors or hydroelectronic temperature sensors. The water 42 flows over the wells 66 and 68, which transfers heat to the temperature sensors 70 and 74. The temperature signal generated by sensor 70 is sent to a thermostat (not shown) located in the spa controller through signal line 75. The thermostat compares the temperature signal with a desired preset water temperature value and regulates the voltage applied to the heater coil 52 to achieve the desired water temperature.

The temperature signal generated by sensor 74 is sent to a kill switch (not shown) located in the controller 43 through signal line 77. The kill switch will shut down the heater coil 52 in the event that the thermostat malfunctions and the water temperature exceeds a preset upper limit.

FIG. 4 illustrates the circulating and heating system embodiment of FIG. 2 (with common elements labeled with the same reference numbers used in FIG. 2), but modified so that water filtration is performed at the input side of the high speed pump. In this embodiment, a combination skimmer/water filter 76 and a suction fitting 78 with a built in by-pass valve 80 are used in place of the skimmer 44 and suction fitting 46, respectively, of FIG. 2.

When the low speed pump 34 is activated and the high speed pump 38 is idle, the by-pass valve 80 remains in a closed position, which cuts off the flow of water through the suction fitting 78. Thus, water 42 is only drawn in through the skimmer/filter 76, which filters the water as it is drawn in. This eliminates the need for the separate filter 30 used in the embodiment of FIG. 2. When the high speed pump 38 is turned on, enough suction is generated to open by-pass valve 80, thereby allowing water 42 to be drawn in through suction fitting 78. The operation of the rest of the system is the same as that described for FIG. 2 above.

Numerous other variations and alternate embodiments will occur to those skilled in the art without departing from the spirit and scope of the invention. For example, although the low and high speed circulation systems are interconnected in the preferred embodiment to increase water filtration when the spa is in use, the invention may be practiced with low and high speed circulation systems that are independent of each other. Accordingly, it is intended that the invention be limited only in terms of the appended claims.

I claim:

1. A water circulation and heating system for a spa, comprising:

a heater, a low speed water pump connected to circulate spa water through said heater in a generally vertical direction, said pump causing water to flow through said heater at a first flow rate that would cause air entrapment in said heater if said water flowed through it horizontally, a plurality of low speed water jets, a first set of piping connecting said heater, low speed jets and low speed water pump, said first set of piping, heater, low speed jets and low speed plump comprising a low speed water circulation system, a plurality of high speed water jets, a high speed water pump connected to circulate said water through said high speed jets when said high speed pump is activated. and a second set of piping connecting said high speed pump and said high speed jets, said second set of piping, high speed pump and high speed jets comprising a high speed water circulation system, said high speed pump circulating spa water in said high speed circulation system at a flow rate that is higher than said first flow rate through said heater.

2. The system of claim 1, wherein said heater comprises:

a cylindrical housing having an input port and an output port, and a heating element disposed within said housing, said housing positioned generally vertically.

3. The system of claim 2, wherein said heater further comprises a temperature sensor positioned adjacent to said input port for monitoring the temperature of said spa water.

4. The system of claim 2, wherein said heating element comprises a helical heating coil.

5. The system of claim 1, further comprising a water filter connected to said low speed water circulation system through said first set of piping.

6. The system of claim 5, wherein said low speed pump circulates said water through said heater and filter at a flow rate between approximately 19 and 23 lpm.

7. The system of claim 6, wherein said low and high speed water circulation systems are interconnected so that a portion of the water from said high speed pump circulates through said heater and filter to boost the total flow rate through said heater and filter when said high speed pump is activated.

8. The system of claim 7, wherein said low and high speed water circulation systems are interconnected so that the total flow rate through said heater and filter is boosted to approximately 38–46 lpm when said high speed pump is activated.

9. The system of claim 1, wherein said low and high speed water circulation systems are interconnected, and further comprising a water filter connected to said high speed water circulation system through said second set of piping, said low speed pump circulating said water through said water filter at a flow rate between approximately 19 and 23 lpm.

10. A water circulation and heating system for a spa, comprising:

a heater, a water filter, a low speed water pump connected to circulate spa water through said heater and filter, a plurality of low speed water jets, a first set of piping connecting said heater, water filter, low speed jets and low speed water pump, said first set of piping, heater, water filter, low speed jets and low speed pump comprising a low speed water circulation system, a plurality of high speed water jets, a high speed water pump connected to circulate said water through said high speed jets when said high speed pump is activated, and a second set of piping connecting said high speed pump and said high speed jets, said second set of piping, high speed pump and high speed jets comprising a high speed water circulation system, wherein said low and high speed water circulation systems are interconnected so that a portion of the water from said high speed pump circulates through said heater and filter to boost the total flow rate through said heater and filter when said high speed pump is activated.

11. The system of claim 10, wherein said low and high speed water circulation systems are interconnected so that the total flow rate through said heater and filter is boosted to approximately 38–46 lpm when said high speed pump is activated.

* * * * *